United States Patent [19]

Hisatomi

[11] 4,243,005

[45] Jan. 6, 1981

[54] IGNITION SYSTEM IN DUAL SPARK PLUG IGNITION ENGINE WITH EGR SYSTEM

[75] Inventor: Takashi Hisatomi, Yokohama, Japan

[73] Assignee: Nissan Motor Company, Limited, Yokohama, Japan

[21] Appl. No.: 900,574

[22] Filed: Apr. 27, 1978

[30] Foreign Application Priority Data

Apr. 29, 1977 [JP] Japan ..... 52-54794[U]

[51] Int. Cl.[3] ..... F02P 15/02; F02B 35/00; F02N 17/08

[52] U.S. Cl. ..... 123/638; 123/310; 123/179 BG; 123/568

[58] Field of Search ..... 123/148 DS, 148 C, 179 BG, 123/179 B, 119 A; 361/249, 250, 261; 315/226

[56] References Cited

U.S. PATENT DOCUMENTS

| | | | |
|---|---|---|---|
| 1,940,614 | 12/1933 | Walters | 123/148 DS |
| 3,407,797 | 10/1968 | Ishibashi | 123/148 DS |
| 3,779,349 | 12/1973 | Maruoka | 123/179 BG |
| 3,809,042 | 5/1974 | Hosho et al. | 123/148 C |
| 3,828,752 | 8/1974 | Hioki et al. | 123/148 DS |
| 3,970,049 | 7/1976 | Yamaguchi et al. | 123/148 DS |
| 4,116,179 | 9/1978 | Nagumo et al. | 123/119 A |
| 4,116,181 | 9/1978 | Nakajima et al. | 123/119 A |
| 4,133,330 | 1/1979 | Nakajima et al. | 123/148 DS |

*Primary Examiner*—P. S. Lall

*Attorney, Agent, or Firm*—Schwartz, Jeffery, Schwaab, Mack, Blumenthal & Koch

[57] ABSTRACT

A dual spark plug ignition engine with an EGR system is provided with an ignition system which is arranged to achieve single spark plug ignition by sensing a considerably low intake vacuum which represents high power output engine operating range. The engine is further provided with an engine starting sensing switch to cause the ignition system to carry out dual spark plug ignition during engine starting although the intake vacuum is considerably low as at the high power output engine operating range.

14 Claims, 6 Drawing Figures

IGNITION SYSTEM IN DUAL SPARK PLUG IGNITION ENGINE WITH EGR SYSTEM

BACKGROUND OF THE INVENTION

This invention relates to an improvement in a dual spark plug internal combustion engine having two spark plugs in each combustion chamber thereof, which is provided with an EGR (Exhaust Gas Recirculation) system for recirculating a considerably large amount of exhaust gases back to the combustion chamber.

In connection with the control of nitrogen oxides (NOx) formed in automotive internal combustion engines, a dual spark plug internal combustion engine provided with an EGR system has been proposed as disclosed in the pending application of Yasuo Nakajima et al., U.S. Pat. Ser. No. 815,449, filed on July 13, 1977 and entitled "Multiple Spark Ignition Internal Combustion Engine with Exhaust Gas Recirculation", now abandoned. In such an engine, two spark plugs are located relatively separate from each other in each combustion chamber. They ignite the air-fuel mixture which is mixed with exhaust gases recirculated back into the engine intake air at a relatively high EGR rate (the volume rate of recirculated exhaust gases relative to engine intake air), for example, about 30%. By virtue of the dual spark plug ignition, fast burn is achieved in the combustion chamber even though the air-fuel mixture is mixed with a considerably large amount of inert exhaust gases. NOx formation is greatly lowered without degradation of engine stability, resulting in an improvement in the driveability of a motor vehicle on which the engine is mounted.

The engine of this type requires operation on a single spark plug ignition in which one of the two spark plugs in each combustion chamber is put into inoperative condition during high power output engine operating condition. If dual spark plug ignition is continued during high power output engine operation, combustion pressure in the combustion chamber is excessively raised, shortening the life of the engine and increasing engine noise. This excessive rise in combustion pressure results from improved combustion in the combustion chamber, which is caused by the fact that charging efficiency of the engine is improved and EGR rate is decreased to a great extent from view points of engine power output and fuel economy during high power output engine operation.

In view of the above, it has also been proposed, as disclosed in the pending application of Shigeo Muranaka et al, U.S. Pat. Ser. No. 787,211, filed on Apr. 13, 1977 and entitled "Improved Dual Spark Plug Ignition Engine", now U.S. Pat. No. 4,144,860, that one of two spark plugs in each combustion chamber is rendered inoperative upon sensing a low intake vacuum which represents the high power output engine operation. However, such an engine has encountered the problem in which dual spark plug ignition is not operable during engine starting even though dual spark plug ignition is necessary for effectively initiating ignition of the air-fuel mixture. This results from the fact that the intake vacuum is very low or close to atmospheric pressure because of very low engine speed during cranking by the starting motor.

SUMMARY OF THE INVENTION

It is an object of the present invention to provide an improved dual spark plug ignition engine provided with an EGR system while life of which can be prolonged, achieving easy starting of the engine.

Another object of the present invention is to provide an improved dual spark plug ignition engine provided with an EGR system, in which single spark plug ignition is carried out during high power output engine operation to prevent lowering of engine durability and increase in engine noise, and dual spark plug ignition is carried out during engine starting to achieve easy or good starting of the engine.

A further object of the present invention is to provide an improved dual spark plug ignition engine provided with an EGR system, in which, although an engine operating parameter represents high power output engine operating range wherein single spark plug ignition is required, dual spark plug ignition is carried out during engine starting.

A still further object of the present invention is to provide an improved dual spark plug ignition engine provided with an EGR system, in which, although intake vacuum reaches a value representing high power output engine operating range wherein single spark plug ignition is required, dual spark plug ignition is carried out during engine cranking.

Other objects, features and advantages of the engine according to the present invention will become more apparent from the following description taken in conjunction with the accompanying drawings.

DESCRIPTION OF THE PREFERRED EMBODIMENTS

Figure 1:
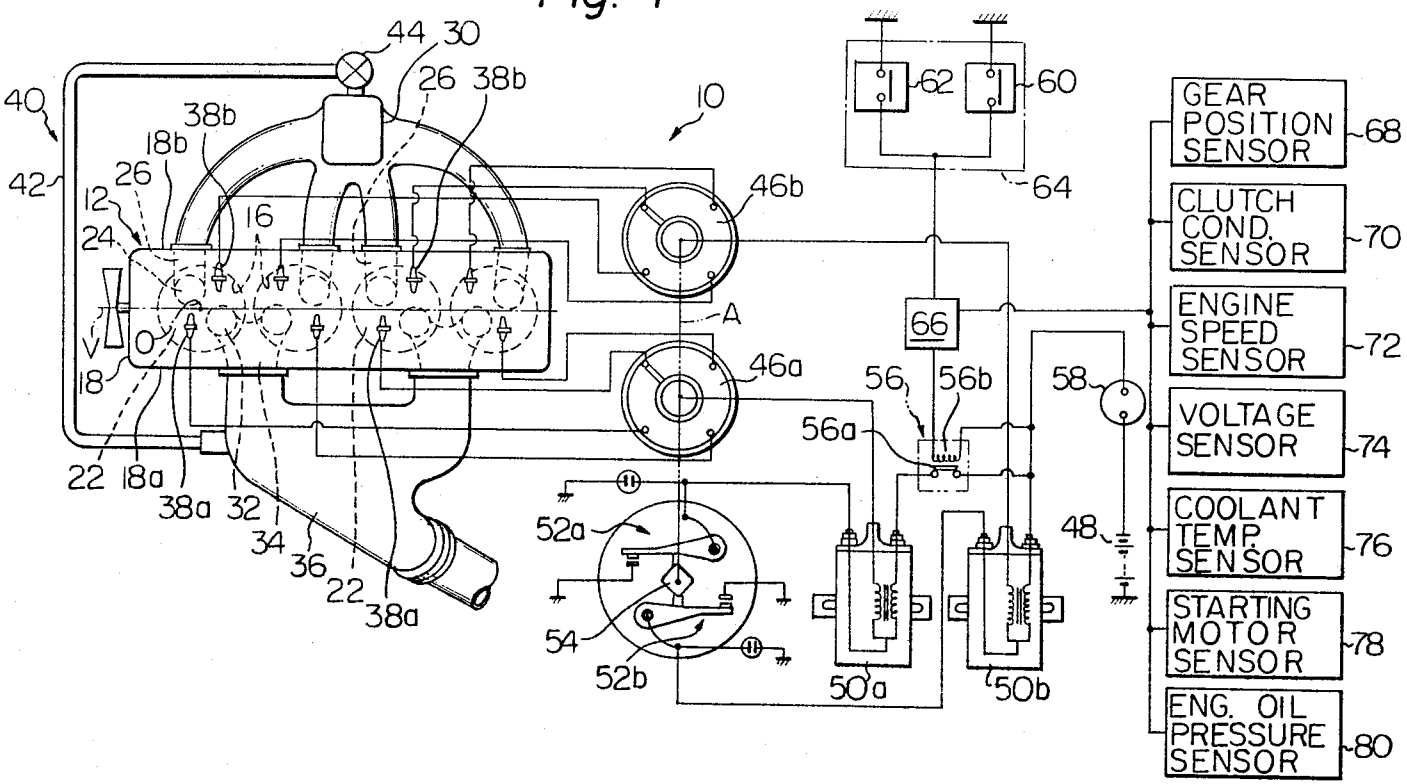
FIG. 1 is a schematic view of a preferred embodiment of an engine in accordance with the present invention, provided with an example of ignition system for spark plugs of the engine.
Figure 2:
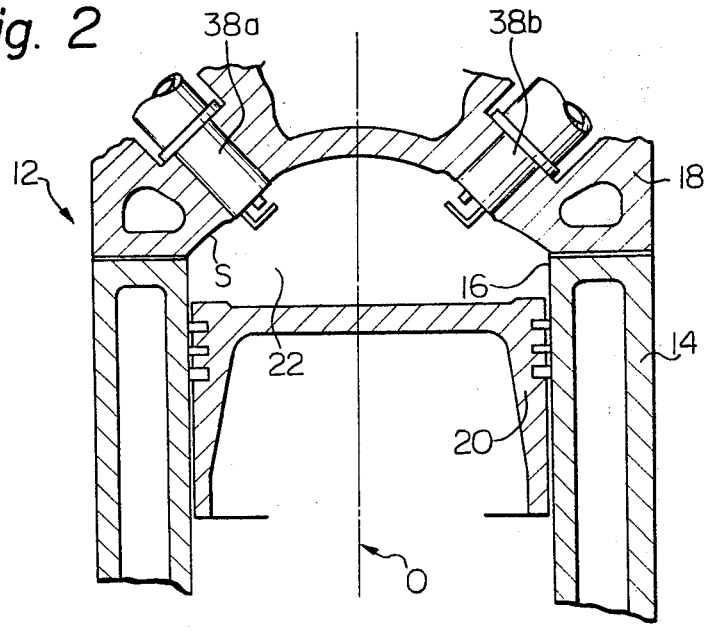
FIG. 2 is a vertical cross-sectional view of the combustion chamber of the engine of FIG. 1 and the locations of two spark plugs.

Referring now to FIGS. 1 and 2 of the drawings, a preferred embodiment of an internal combustion engine 10 in accordance with the present invention is shown as including an engine 12 thereof. The engine 12 is composed of a cylinder block 14 in which four engine cylinders 16 are formed as shown. Secured to the top portion of the cylinder block 14 is a cylinder head 18 which is formed with a concavity surface S of which closes one end of the cylinder 16. A piston 20 is disposed reciprocally movable within the cylinder 16. A combustion chamber 22 is defined by the cylindrical inner wall surface of the cylinder 16, the concavity surface S of the cylinder head 18, and the crown of the piston 20.

Each combustion chamber 22 is communicable through an intake valve 24 to an intake port 26 which, in turn, communicates through an intake manifold 28 to an intake passage with a carburetor 30. The carburetor 30 is, in this case, arranged to supply the combustion chamber 22 with air-fuel mixture having an air-fuel ratio within the stoichiometric region or a range from 13:1 to 16:1. The combustion chamber 22 is further communicable through an exhaust valve 32 with an exhaust port 34. The exhaust port 34 is shared by adjacent two cylinders 16 and accordingly is referred to as a so-called siamesed exhaust port. The exhaust port 34 communicates with an exhaust manifold 36 which serves as a thermal reactor for thermally oxidizing the unburned constituents contained in the exhaust gases discharged from the combustion chamber 22. As seen, the cylinder head 18 in this case employs a cross-flow induction-exhaust arrangement in which the exhaust port 34 opens to one side surface 18*a* thereof and the intake port 26 opens to an opposite side surface 18*b* thereof.

In each combustion chamber 22, a first spark plug 38*a* and a second spark plug 38*b* are disposed being secured to the cylinder head 18 so that the electrodes (no numerals) thereof project and lie in the combustion chamber 22. The first spark plug 38*a* is located such that its electrodes lie at the same side as the cylinder head side surface 18*a* with respect to an imaginary longitudinal vertical plane V which extends parallel to the longitudinal axis (not shown) of the cylinder head 18 and passes through the center axis O of the cylinder bore or center axes of the cylinder bores as clearly shown in FIG. 1. On the contrary, the second spark plug 38*b* is located at the same side as the cylinder head side surface 18*b*. Hence, the first and second spark plugs 18*a* and 18*b* are located opposite with respect to the longitudinal vertical plane V.

The ference numeral 40 represents an Exhaust Gas Recirculation (EGR) system or means for recirculating a portion of the exhaust gases into the combustion chamber 22. The EGR system 40 is composed of a conduit 42 or a passageway which connects the exhaust manifold 36 forming part of an exhaust system (no numeral) to the the intake manifold 28 forming part of an intake system (no numeral). Disposed in the conduit 42 is a control valve 44 which is arranged to control the amount of the exhaust gases recirculated from the exhaust system into the combustion chamber with respect to the amount of the intake air inducted through the intake system into the combustion chamber 22. The valve may be operable in response, for example, to the venturi vacuum which is a function of the amount of the intake air. In this case, the control valve 44 is arranged to set the amount of the exhaust gases recirculated back to the combustion chamber to a high volume rate relative to the intake air. This volume rate of recirculated exhaust gases is referred to an "EGR rate".

Each first spark plug 38*a* is electrically connected to a corresponding terminal of a first distributor 46*a* which functions, as usual, to distribute high voltage current supplied thereto to the first spark plugs 38*a* disposed in respective combustion chambers 22. The high voltage current is supplied from a first transforming device (no numeral) or first transforming means for transforming the electric current from an electric source such as a battery 48 into high voltage current. The first transforming device is composed of a first ignition coil 50*a* electrically connected to the first distributor 46*a*. The first ignition coil 50*a* is, as customary, further electrically connected to a first contact breaker 52*a* which is driven by means of a revolving cam 54.

Similarly, each second spark plug 38*b* is electrically connected to a corresponding terminal of a second distributor 46*b* which is, in turn, electrically connected to a second ignition coil 50*b* forming part of a second transforming device (no numeral) or second transforming means for transforming the electric current from the battery 48 into high voltage current. The second ignition coil 50*b* is electrically connected to a second contact breaker 52*b* which is driven by means of the revolving cam 54. It will be understood that the rotors (no numerals) of the first and second distributors and the revolving cam 54 are arranged on the same axis A and therefore the rotors of the first and second distributors 46*a*, 46*b* rotate with the revolving cam 54.

The first ignition coil 50*a* is electrically connectable to the battery 48 through a normally closed electromagnetic relay switch 56 and an ignition switch 58. The second ignition coil 50*b* is electrically connected through the ignition switch 58 to the battery 48. The electromagnetic relay switch 56 is so constructed and arranged that its movable contact 56*a* is separated from its stationary contacts (no numerals) to interrupt the electrical connection between the first ignition coil 50*a* and the battery 48 when its electromagnetic coil 56*b* is energized. The electromagnetic coil 56*a* of the relay switch 56 is electrically connected to an intake vacuum responsive switch 60 and a throttle position sensitive switch 62 which are electrically connected in parallel with each other. The intake vacuum responsive switch 60 is constructed and arranged to close to supply the electromagnetic coil 56*b* with the electric current from the battery 48. The coil 56*b* is energized when intake vacuum in the intake manifold 28 is lower or closer to atmospheric pressure than a predetermined level, such as 80 mmHg. The throttle position sensitive switch 62 is constructed and arranged to close to supply the coil 56*b* with the electric current from the battery 48 when the opening angle of the throttle valve (not shown) of the carburetor 30 exceeds or is larger than a predetermined angle such as 40 degrees. The above-mentioned ranges of intake vacuum and the throttle valve opening angle represent an engine operation within a high power output engine operating condition in which the engine generates a so-called high power output. It is now to be noted that effective combustion takes place in the combustion chamber even by ignition only with the second spark plug 38*b* within the high power output engine operating range. Therefore, the switches 60 and 62 constitute a switching device 64 which senses the high power output engine operating range and energizes the electromagnetic coil 56*b* of the relay switch 56. It will be understood that, in this case, when either one of the switches 60 and 62 is closed, the coil 56*b* of the relay switch 56 will be energized to interrupt the electrical connection between the first ignition coil 50*a* and the battery 48 to put each first spark plug 38*a* into the inoperative condition.

The reference numeral 66 denotes a switch forming part of an engine starting sensing switch (no numeral). The switch 66 is electrically connected between the coil 56*b* of the relay switch 56 and the switching device 64. The engine starting sensing switch is constructed and arranged to open to interrupt the electrical connection between the relay switch 56 and the switching device 64 during engine starting or engine cranking. Therefore, this switch 66 is electrically connected to at least one of a gear position sensor 68 which is actuated to open the switch 66 when the gear in a gear box (not shown) of the engine is in "neutral position", a clutch condition sensor 70 which is actuated to open the switch 66 when the clutch plate of a clutch of the engine is put into a condition to interrupt the transmission of the power from the engine to road wheels of a vehicle, an engine speed sensor 72 which is actuated to open the switch 66 when the speed of the engine is in a range corresponding to the engine starting or engine cranking, for example, 500 r.p.m. (when idling is about 600 r.p.m.), a voltage sensor 74 which is actuated to open the switch 66 when the output voltage of an alternator is within a range corresponding to the engine starting or engine cranking, for example, 12V, an engine coolant temperature sensor 76 which is actuated to open the switch 66 when the temperature in an engine coolant (not shown) represents a condition where engine operation or combustion in the engine has not yet begun, for example, 20° C., a starting motor sensor 78 which is actuated to open the switch 66 upon actuation of a starting motor (not shown) for starting the engine, and an engine oil pressure sensor 80 which is actuated to open the switch 66 when the pressure in an engine oil (not shown) of the engine represents a condition where the engine operation has not yet begun, for example, 3 kg/cm$^2$.

Figure 4:
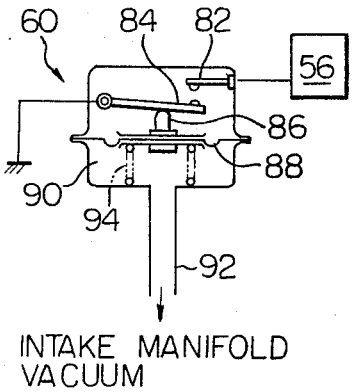
FIG. 4 is a schematic sectional view of an example of an intake vacuum responsive switch used in the engine of FIG. 1.

FIG. 4 shows in detail an example of the intake vacuum responsive switch 60 which is composed of a stationary contact 82 electrically connected to the electromagnetic oil of the actuator 56 and a grounded movable contact 84. The movable contact 84 is arranged to contact the stationary contact 82 when urged in an upward direction in the drawing by a push-rod 86. The push-rod 86 is secured to a diaphragm member 88 which defines a vacuum chamber 90. The vacuum chamber 90 communicates with the inside of the intake manifold 28 through a vacuum passage 92. A spring member 94 is disposed in the vacuum chamber 90 to urge the diaphragm member 88 in the upward direction in the drawing so that the push-rod 86 causes the movable contact 84 to contact the stationary contact 82. With the arrangement of this vacuum operated switch 60, when the intake manifold vacuum falls below the predetermined level, such as 80 mmHg, the spring member 94 pushes the diaphragm member 88 up against the vacuum transmitted from the intake manifold 28, causing the movable contact 84 to contact the stationary contact 82 so as to energize the coil **56*b***.

Figure 5:
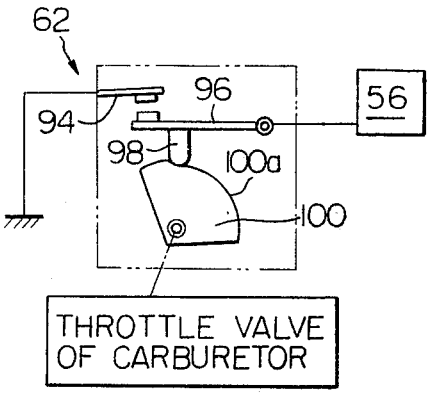
FIG. 5 is a schematic sectional view of an example of throttle position sensitive switch used in the engine of FIG. 1.

FIG. 5 shows in detail an example of the throttle position sensitive switch 62. This throttle position sensitive switch 62 is composed of a grounded stationary contact 94 and a movable contact 96 which is electrically connectable to the electromagnetic coil **56*b* of the relay suite 56. The movable contact 96 is provided with a projection 98 which slidably contacts the contoured cam surface 100*a* of a cam 100. Consequently, the projection 98 serves as a cam follower. The cam 100 is operatively connected to the throttle shaft on which a throttle valve (not shown) of the carburetor 30 is fixed and therefore the cam 100 rotates with the throttle shaft of the carburetor 30. The contoured cam surface 100*a* is arranged to push the projection 98 to cause the movable contact 96 to contact the stationary contact 94 in order to energize the electromagnetic coil 56*b* of the switch 56** when the opening degree of carburetor throttle valve becomes larger than the predetermined angle of, for example, 40 degrees.

The operation of the engine 10 according to the present invention illustrated in FIGS. 1, 2, 4 and 5 will now be explained.

At normal engine operating range, the intake manifold vacuum is relatively high, i.e. higher than 80 mmHg, and the opening angle of the throttle valve is relatively small, i.e. smaller than 40 degrees. Accordingly, both the switches 60 and 62 are open preventing the electromagnetic coil **56*b* of the relay switch 56 from being energized. In this state, the electromagnetic relay switch 56 is closed to establish the electrical connection between the first ignition coil 50*a* and the battery 48. Of course, the electrical connection is maintained between the second ignition coil 50*b* and the battery 48 at all times during engine operation. The high voltage currents generated by the first and second ignition coils 50*a*, 50*b* are transmitted through the first and second distributors 46*a*, 46*b* to the four first spark plugs 38*a* and the four second spark plugs 48*b*, respectively. In other words, the four first spark plugs 38*a* and the four second spark plugs 38*b* are put into their operative conditions. Accordingly, the spark plugs 38*a* and 38*b* ignite the air-fuel mixture inducted through the intake port 26 into the combustion chamber 22. It is to be noted that the engine of this case is constructed to substantially simultaneously supply the high voltage current to the first and second spark plugs 38*a* and 38*b***, and therefore the first and second spark plugs are arranged to substantially simultaneously produce sparks to ignite the air-fuel mixture.

Hence, fast burn of the air-fuel mixture can be effectively achieved in the combustion chamber 22 even though exhaust gases are recirculated at a relatively high EGR rate. The recirculation to the combustion chamber 22 by the exhaust gas recirculation system 40, causes the formation level of NOx to be remarkably lowered without degradation of the engine stability and driveability.

At high power output engine operating range, the intake manifold vacuum is relatively low, i.e. lower than 80 mmHg, the opening angle of the throttle valve is relatively large, i.e. larger than 40 degrees. Then, both the switches 60 and 62 are closed to complete an electric circuit, causing the coil **50*b* of the relay switch 56 to be energized. In this state, the relay switch 56 is opened to interrupt the electrical connection between the battery 48 and the first ignition coil 50*b*. As a result, provision of the high voltage current to the four first spark plugs 38*a* is stopped to put first spark plugs 38*a* into their inoperative conditions, whereas the four second spark plugs 38*b*** are continued to be provided with the high voltage current to maintain them in their operative conditions. In other words, dual spark plug ignition is changed into single spark plug ignition when the normal engine operation is changed into the high power output engine operation.

In general, it is unnecessary to carry out the dual spark plug ignition within the high power output engine operating range, since combustion in the combustion chamber 22 is greatly improved due to improved charging efficiency and a decrease in EGR rate which takes place during high power output engine operation. In this regard, it is desirable to carry out the single spark plug ignition during high power output engine operation for the purpose of preventing generation of excessively high combustion pressure which results in increased engine noise and unusual engine vibration, contributing to lowered engine durability and decreased engine life.

Figure 3:
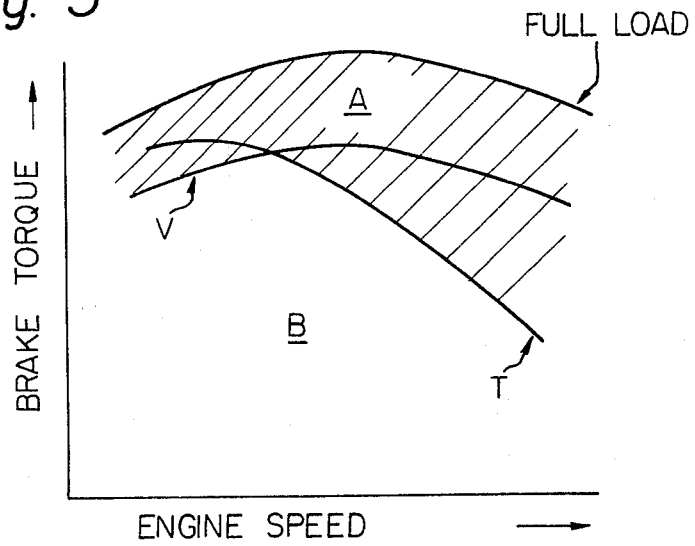
FIG. 3 is a graph showing the parameters for sensing high power output of the engine of FIG. 1, in terms of brake torque and engine speed.

Now, as is apparent from the foregoing discussion, the engine shown in FIG. 1 is so arranged that the dual spark plug ignition is changed into the single spark plug ignition when either one of intake vacuum and throttle valve opening angle reaches its predetermined level. Therefore, the high power engine operating condition can be considerably precisely sensed as shown in FIG. 3 in which a range A indicated by oblique lines represents the high power output engine operating range where the single spark plug ignition is carried out, whereas a range B presents the normal engine operating range including engine starting where the dual spark plug ignition is carried out. In FIG. 3, a curve V indicates variation in brake torque obtained by sensing intake manifold vacuum, and a curve T indicates variation in brake torque obtained by sensing the opening angle of the throttle valve of the carburetor. It will be seen from FIG. 3, that the high power output engine operating range can be more precisely sensed by using both the intake vacuum responsive switch and the throttle position sensitive switch, than in a case where only one of these switches is used. However, it is possible to sense the high power output engine operating range by using only one switch, in which case it is desirable to use the intake vacuum responsive switch 60.

The operation of the engine during engine starting will be explained hereinafter.

As the engine starts (or during engine cranking), the switch 66 of the engine starting sensing switch is actuated to open the connection between switching device 64 and the electromagnetic relay switch 56, placing the latter at its closed position to establish the electrical connection between the first ignition coil 50*a* and the battery 48. Accordingly, the first and second spark plugs 38*a* and 38*b* are supplied with high voltage current to be put into their operative conditions. As a result, the dual spark plug ignition is carried out during engine starting or engine cranking.

If the above-mentioned gear position sensor 68 is used as a part of the engine starting sensing switch, the dual spark plug ignition can be maintained as long as the gear in the gear box of the engine is kept in its "neutral position". Furthermore, using the above-mentioned other sensors as a part of the engine starting sensing switch, it is possible to actuate the switch 66 in accordance with the condition of the clutch, engine speed, the output voltage of the alternator, the condition of the starting motor, the pressure in the engine coil etc.

It is to be noted that, if the engine starting sensing switch is not used, the electromagnetic relay switch 56 is energized to put the first spark plug 38*a* into its inoperative condition during engine starting since intake manifold vacuum is very low or close to atmospheric pressure. This single spark plug ignition is undesirable during engine starting because better engine starting can be achieved by the dual spark plug ignition as compared with ignition by the single spark plug.

By using the engine coolant temperature sensitive switch as a part of the engine starting sensing switch, it is possible to prevent undesirable change into the single spark plug ignition which change may be caused by unnecessary acceleration during cold starting and during warming-up of the engine. Therefore, the dual spark plug ignition can be securely maintained until warming-up of the engine is completed so as to raise engine temperature to a desirable level.

Figure 6:
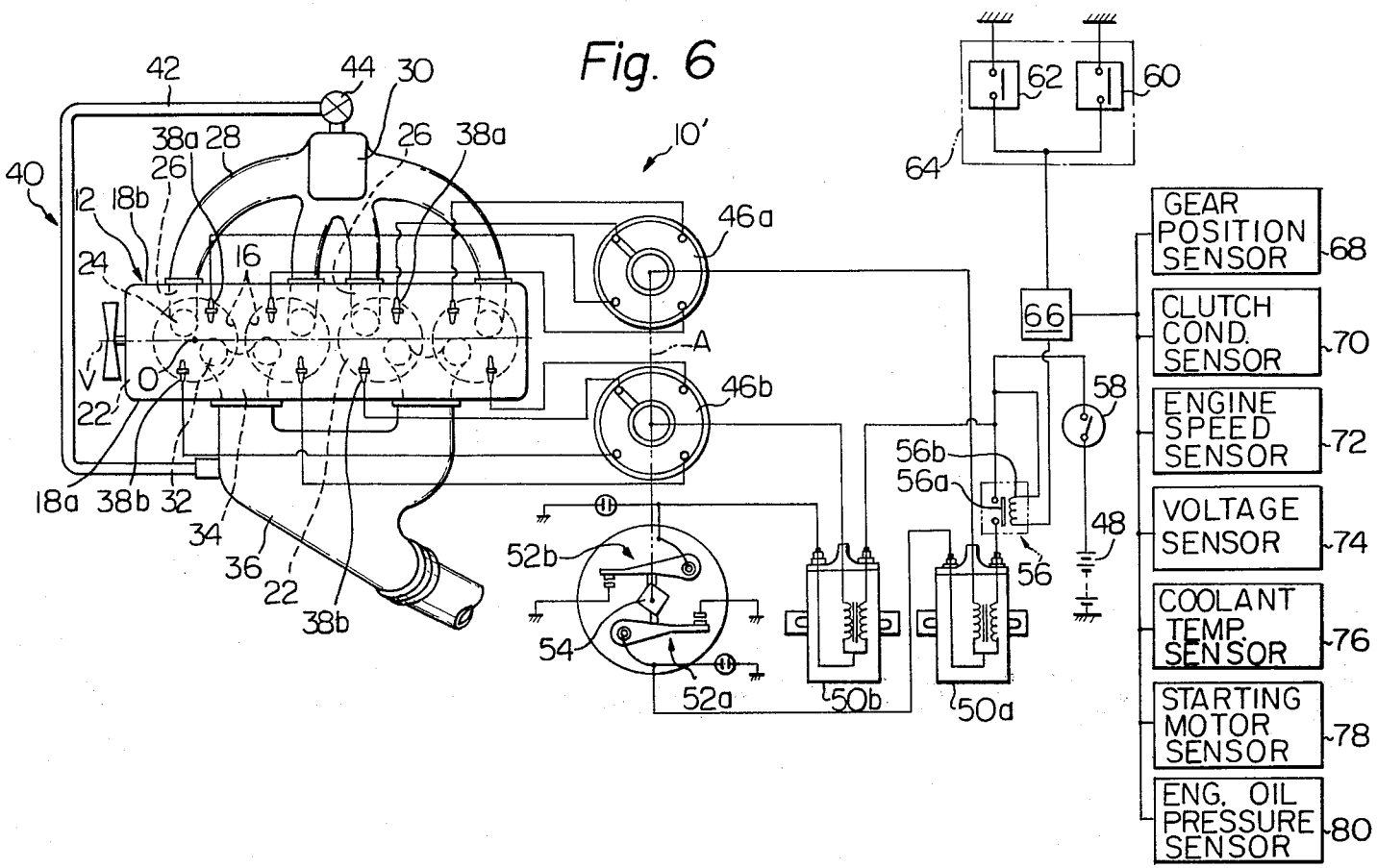
FIG. 6 is a schematic view similar to FIG. 1, but shows another preferred embodiment of the engine in accordance with the present invention.

FIG. 6 illustrates another preferred embodiment of the engine 10' in accordance with the present invention, which is similar to the engine 10 shown in FIG. 1 except for the location of the first and second spark plugs 38*a* and 38*b* in the combustion chamber 22. In FIG. 6, the same reference numerals as in FIG. 1 represent the same parts and elements.

In this case, the first spark plug 38*a* is located such that its electrodes lie at the same side as the cylinder head side surface 18*b* with respect to the longitudinal vertical plane V to which surface 18*b* the intake port 26 opens, and lie adjacent the intake valve head 24. Furthermore, the first and second spark plugs 38*a* and 38*b* are located so that the midpoints (not identified) of the spark gaps of the spark plugs 38*a* and 38*b* lie substantially symmetrically with respect to the cylinder center axis O, as viewed from the direction of the cylinder axis O or in plan view of the cylinder shown in FIG. 6. The spark gap of each spark plug is, as usual, defined between the electrodes thereof. It will be appreciated that the electrodes of the first spark plug 38*a* are prevented from excessive cooling due to the direct striking thereagainst of incoming cool gas or new air-fuel mixture inducted through the intake port 26 into the combustion chamber 22. On the contrary, the second spark plug 38*b* is located such that its electrodes lie at the same side as the cylinder side surface 18*a* with respect to the longitudinal vertical plane V to which surface 18*a* the exhaust port 34 opens.

Therefore, it will be understood that, with the above-described spark plug location, the first spark plug 38*a* is not subjected to the cooling effect of the new air-fuel mixture and therefore the first spark plug 38*a* can effectively operate even when the high voltage current is again supplied thereto after supply of the current has been stopped. Furthermore, the second spark plug 38*b* is always operated during engine operation and accordingly the second spark plug is prevented from excessive cooling, contributing to prevention of carbon deposite formation on the surface of the electrodes of the spark plug.

What is claimed is:

1. A four stroke internal combustion engine having a combustion chamber defined between a cylinder head and a piston, said engine having an exhaust and an intake and an electric source, said engine further including means for recirculating a portion of exhaust gases from the engine back to the engine intake, said engine including:

first and second spark plugs disposed in the combustion chamber and operative to ignite an air-fuel mixture applied to said combustion chamber;

first transforming means for transforming electric current from said electric source into a high voltage current, electrically connectable to said first spark plug for placing said first spark plug in an operative condition;

second transforming means for transforming electric current from said electric source into a high voltage current, electrically connectable to said second spark plug for putting said second spark plug into an operative condition;

first switching means, responsive to at least one engine operating parameter, for interrupting an electrical connection between said first transforming means and said electric source when said at least one engine operating parameter is at a predetermined value indicative of a high power output engine operating range; and second switching means, responsive to an engine operating parameter indicative of engine starting, for establishing an electrical connection between said first transforming means and said electric source, said second switching means independent of the operation of said first switching means:

said first switching means comprises a relay switch electrically connected between said first transforming means and the electric source to interrupt the electrical connection therebetween when actuated, and an intake vacuum responsive switch to be actuated to, in turn, actuate said relay switch when intake vacuum of the engine is below a predetermined level which is encountered at the high power output engine operating range, and said second switching means comprises:

an engine starting sensing switch to interrupt the electrical connection between said relay switch and said intake vacuum responsive switch when the engine operating parameter represents the engine starting.

2. An internal combustion engine as claimed in claim 1, in which said engine starting sensing switch includes an interruption switch electrically connected between said relay switch and said intake vacuum responsive switch to interrupt the electrical connection therebetween when actuated.

3. An internal combustion engine as claimed in claim 2, in which said engine starting sensing switch includes a gear position sensor which actuates said interruption switch when the gear in a gear box is in "neutral position".

4. An internal combustion engine as claimed in claim 2, in which said engine starting sensing switch includes a clutch condition sensor which actuates said interruption switch when the clutch plates of a clutch of the engine are in a condition to interrupt the transmission of the power from the engine to road wheels of a vehicle on which the engine is mounted.

5. An internal combustion engine as claimed in claim 2, in which said engine starting switch includes an engine speed sensor which actuates said interruption switch when engine speed is in a range corresponding to the engine starting.

6. An internal combustion engine as claimed in claim 2, in which said engine starting sensing switch includes a voltage sensor which actuates said interruption switch when the output voltage of an alternator is within a range corresponding to the engine starting.

7. An internal combustion engine as claimed in claim 2, in which said engine starting sensing switch includes an engine coolant temperature sensor which actuates said interruption switch when the temperature of an engine coolant represents a condition where engine operation is still stopped.

8. An internal combustion engine as claimed in claim 2, in which said engine starting sensing switch includes a starting motor sensor which actuates said interruption switch upon actuation of a starting motor.

9. An internal combustion engine as claimed in claim 2, in which said engine starting sensing switch includes an engine oil pressure sensor which actuates said interruption switch when the pressure in an engine oil represents a condition where engine operation is still stopped.

10. An internal combustion engine as claimed in claim 1, in which said first switching means further includes a throttle position sensitive switch electrically connected in parallel with said intake vacuum responsive switch, said throttle position sensitive switch being actuated to, in turn, actuate said relay switch when the opening angle of a throttle valve exceeds a predetermined level.

11. An internal combustion engine as claimed in claim 10, in which said relay switch is a normally closed electromagnetic relay switch which is opened to interrupt the electrical connection between said first transforming means and the electric source when energized upon receiving an electrical signal from at least one of said actuated intake vacuum responsive switch and throttle position switch.

12. An internal combustion engine as claimed in claim 1, in which the combustion chamber is of a hemispherical shape; the midpoints of the spark gaps of said first and second spark plugs are located substantially symmetrical with respect to the center axis of the engine cylinder, as viewed from the direction of the cylinder center axis; said first and second spark plugs are arranged to substantially simultaneously produce sparks, respectively, to ignite an air-fuel mixture in the combustion chamber.

13. An internal combustion engine as claimed in claim 12, in which said first spark plug is located such that its electrodes are prevented from cooling effect due to the direct strike of a cool incoming gas thereagainst.

14. An internal combustion engine as claimed in claim 13, in which the cylinder head is formed with an intake port opened to one side surface thereof and an exhaust port opened to an opposite side surface thereof, said first spark plug being located at the same side as said one side surface of the cylinder head with respect to an imaginary longitudinal vertical plane which extends parallelly with the longitudinal axis of the cylinder head and passes through the center axis of the engine cylinder.

* * * * *